US005641241A

United States Patent [19]

Rushing

[11] Patent Number: 5,641,241

[45] Date of Patent: Jun. 24, 1997

[54] LIGHTED ANTI-GLARE PADDLE SYSTEM

[76] Inventor: Hollis B. Rushing, 4913 Woodlake Dr., Baton Rouge, La. 70817

[21] Appl. No.: 504,071

[22] Filed: Jul. 19, 1995

[51] Int. Cl.[6] ..... E01F 9/016; E01F 15/02

[52] U.S. Cl. ..... 404/6; 256/13.1; 362/152

[58] Field of Search ..... 404/6, 9, 12, 14, 404/7, 8; 256/13.1; 362/152, 249; 116/63 R

[56] References Cited

U.S. PATENT DOCUMENTS

| | | | |
|---|---|---|---|
| 2,135,400 | 11/1938 | Johnson | 404/12 |
| 2,825,796 | 3/1958 | Lanmon | 362/152 |
| 2,920,184 | 1/1960 | Kessler | 362/152 |
| 5,015,119 | 5/1991 | Schmanski | 404/9 X |
| 5,074,705 | 12/1991 | Schmitt | 404/6 |
| 5,181,695 | 1/1993 | Authur | 404/9 X |
| 5,190,394 | 3/1993 | Mallon et al. | 404/6 |
| 5,410,458 | 4/1995 | Bell | 362/249 X |
| 5,453,916 | 9/1995 | Tennis et al. | 404/6 X |

FOREIGN PATENT DOCUMENTS

| | | | |
|---|---|---|---|
| 844581 | 8/1960 | Australia | 362/152 |
| 711622 | 6/1965 | Canada | 362/152 |
| 140916 | 6/1993 | Japan | 404/9 |

*Primary Examiner*—Tamara L. Graysay
*Assistant Examiner*—James A. Lisehora
*Attorney, Agent, or Firm*—Pravel, Hewitt, Kimball & Krieger

[57] ABSTRACT

A median barrier, of the type commonly known, utilizing a plurality of anti-glare paddles mounted onto the barrier for defining a continuous anti-glare system along the lengths of the barrier. There is further provided a system of lighted tubes mounted onto the glare panel with a specific attachment device. In the preferred embodiment, the attachment device is positioned on every fourth glare paddle, and the lighted tube is threaded through tube holders on the top of the attachment device, to define a continuous support for the lighted tube along the length of the barrier system. There is further provided a source of electrical power to the system of lighted tools, in order to effect the lighting within the tubes for use in night time driving.

9 Claims, 2 Drawing Sheets

LIGHTED ANTI-GLARE PADDLE SYSTEM

BACKGROUND OF THE INVENTION

1. Field of the Invention

The system of the present invention relates to glare paddles used along highways. More particularly, the present invention relates to a system of anti-glare panels positioned upon the median barrier of a highway, which incorporates a lighting system for assisting drivers in maneuvering through the area.

2. General Background

During the construction along highways, the highway industry utilizes several concepts in an effort to assist motorists in being guided along the highways where the construction is occurring. For example, when it is necessary that a detour is formed in the highway, where a highway is being worked upon, and, when the traffic must be rerouted around the detour and return onto the main highway, there are usually barriers which are positioned between the traffic moving in opposite directions. At night time, in order to prevent the lights from shining into the eyes of the ongoing traffic, a system of glare paddles are positioned atop the median barrier, so that glare from the ongoing merging traffic is eliminated. Such type paddle is owned by Hollis B. Rushing, which is patented under U.S. Pat. No. Des. 342, 036, entitled, "Glare Panel". Utilizing a series of these glare paddles mounted onto the upper portion of a median barrier, establishes the anti-glare system, which is currently used. A second system is the use of an internally lighted tube that is placed directly on the hand rails or median barrier in order to guide the motorists through a curve or work zone area, which has a great deal of congestion and oncoming traffic. Therefore, although glare is apparently not eliminated in this particular lighting system, it does afford a guide for the driver to maneuver through the barrier system onto the main highway.

Of the two systems which are utilized, each of the systems suffer from shortcomings. For example, when utilizing the system of the glare paddles alone, in particularly in areas which are not lighted at all at night time, motorists have a difficult time recognizing the glare paddles and the median barrier as they are merging back onto the highway, which can create a dangerous situation. In the second concept where there are no glare paddles utilized, but simply a series of lights positioned on the barrier itself, the motorist still suffers from the possibility of facing directly into automobile lights from ongoing traffic which is merging, and of course, that would create the possibility of loss of proper site during night driving conditions.

SUMMARY OF THE PRESENT INVENTION

The system of the present invention solves the shortcoming in the art in a simple and straightforward manner. What is provided is a median barrier, system of the type commonly known, utilizing a plurality of anti-glare paddles mounted onto the barrier for defining a continuous anti-glare system along the lengths of the barrier. There is further provided a system of continuous lighted tubes mounted along the glare paddles with a specific attachment device. In the preferred embodiment, the attachment device is positioned along the top of the glare paddles, and the lighted tube is threaded through tube holders on the attachment devices, to define a continuous support for the lighted tube along the length of the barrier system. There is further provided a source of electrical power to the system of lighted tubes, in order to effect the lighting within the tubes for use in night time driving.

Therefore, it is the principal object of the present invention to provide a system of lighted tubes mounted onto glare paddles so that the lighted tube system is approximately at the eye level of the motorist, and thus makes for a positive guidance device;

It is a further principal object of the present system, to provide continuous lighted tubing atop a system of glare paddles, which provides that because of the height of the lighted tubing, the tubing is out of the splash zone, which reduces the amount of roadway dirt and grime which comes into contact with the tubing, thus extending the life of the tubing;

It is a further object of the present invention to provide a lighted glare paddle system, which provides a combination of the glare paddles mounted onto a median barrier, and the lighted system mounted thereto with a specific mounting feature to allow the glare paddles to be positioned angularly in relation to the glare paddles, yet for the lighted tube to follow in parallel relation with the median barrier itself;

It is a further object of the present invention to provide a lighted glare panel system, which affords the anti-glare feature of the plurality of anti-glare paddles mounted upon the median barrier, and also provides for a continuous lighting system for guiding the motorists through a construction or a merging area of a highway under construction.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
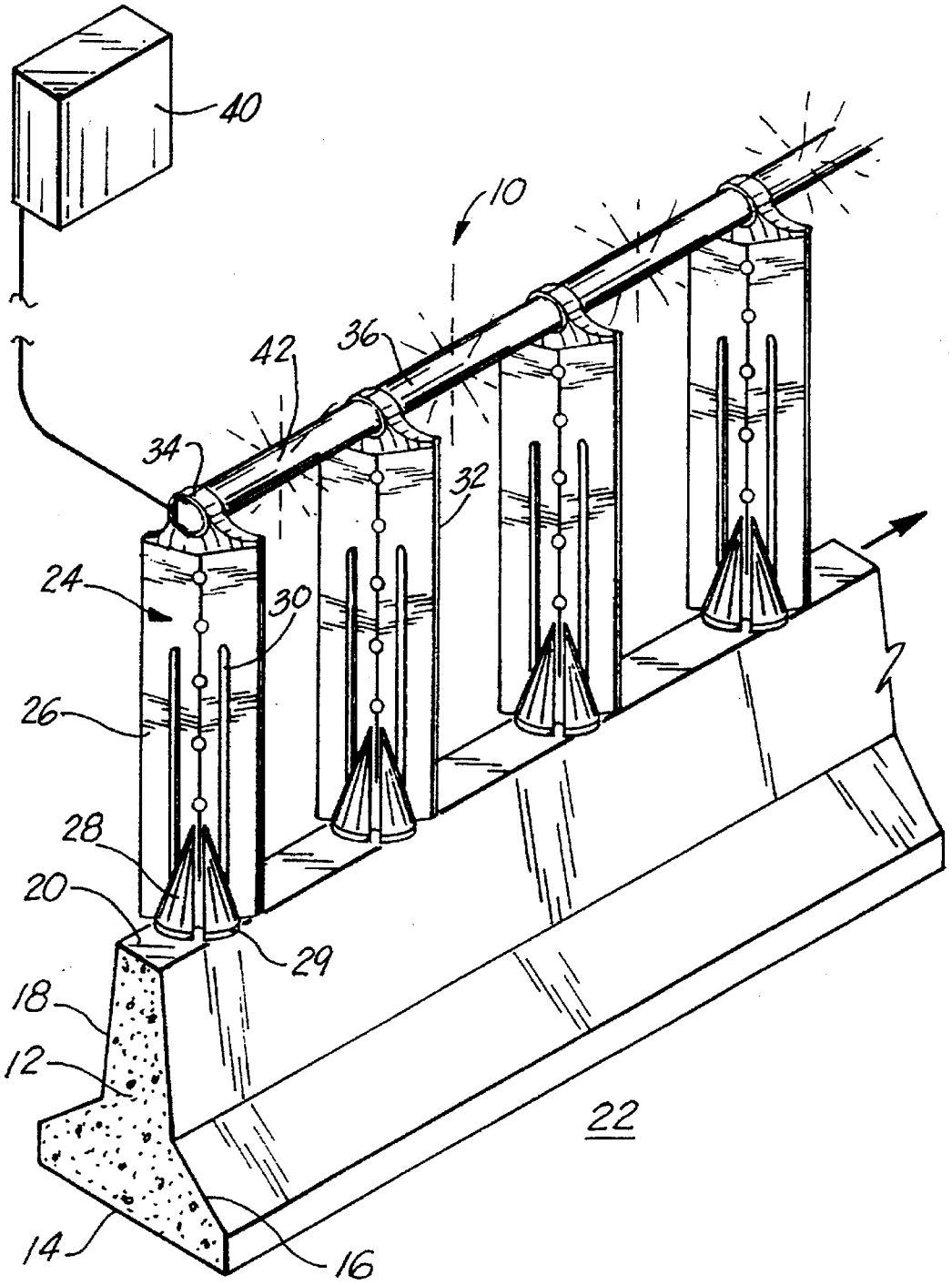
FIG. 1 is a partial perspective view of the system of the present invention.
Figure 2:
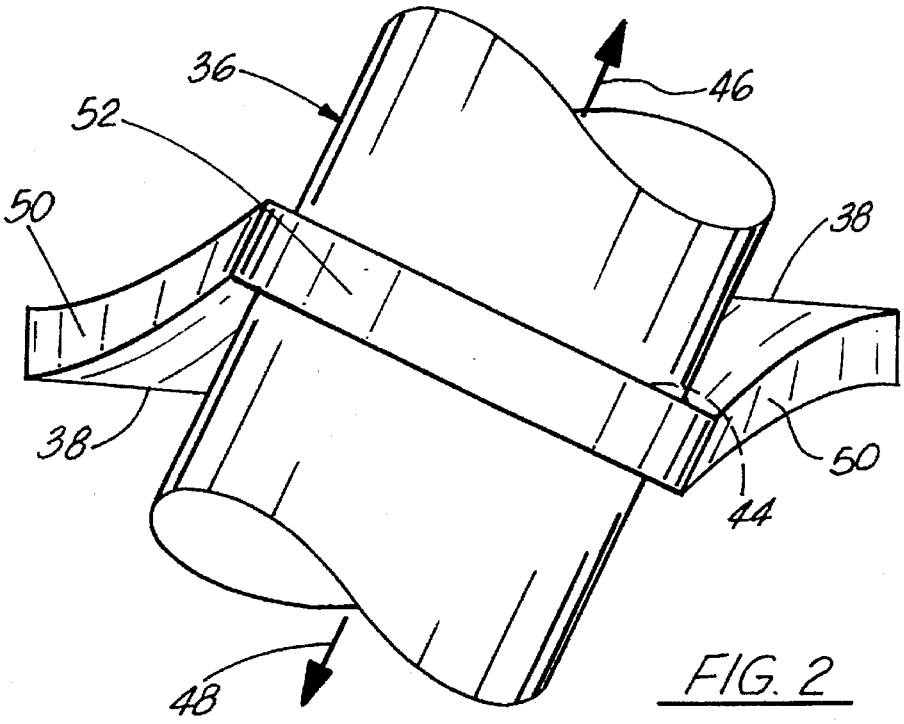
FIG. 2 is a top view of the mounting attachment between the glare panel and the lighting tube of the present invention.
Figure 3:
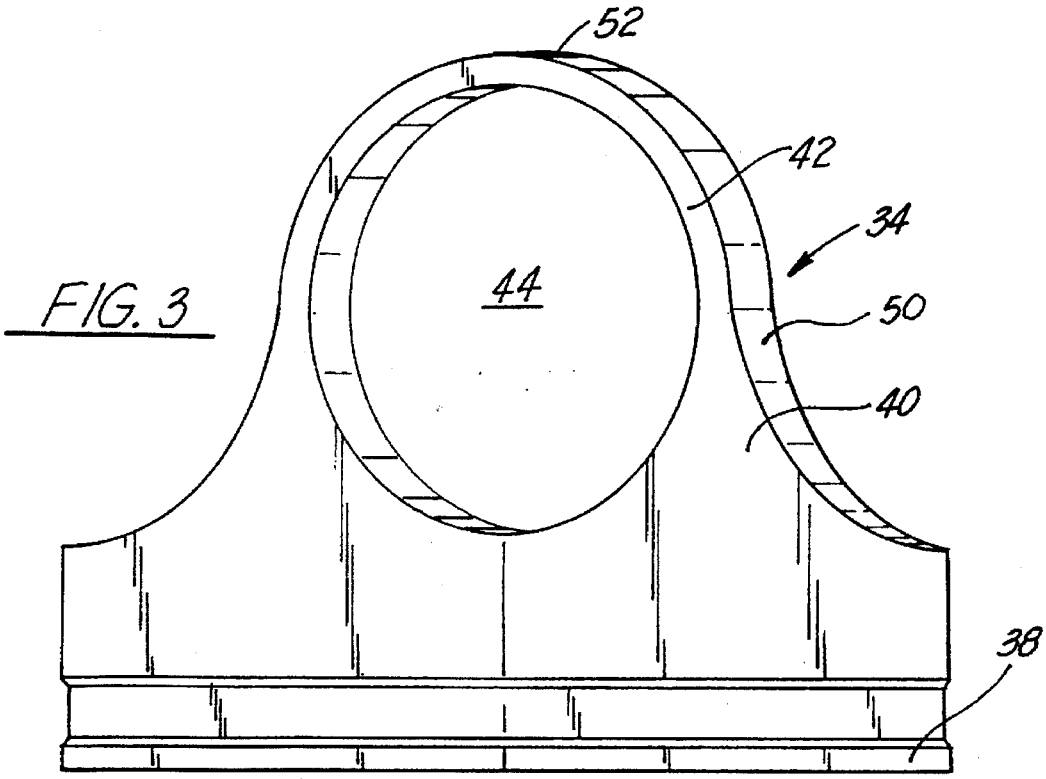
FIG. 3 is an overall view of the attachment device as seen in FIG. 2.

FIGS. 1–3 illustrate the preferred embodiment of the system of the present invention by the numeral 10. As illustrated in partial overall view in FIG. 1, system 10 provides a median barrier 12 having a base portion 14, a pair of formed sidewalls 16, 18, terminating in an upper flat top portion 20. A median barrier 12 is very common in the highway industry, and usually is provided in lengths of ten to twenty feet, which when set end to end, form a continuous barrier between automobile traffic moving in opposite directions. The barrier 12 is usually positioned upon a highway surface 22, as seen in FIG. 1. As further illustrated as part of the system, in order to effect an anti-glare feature into a barrier, there is provided a plurality of paddles 24, each of the paddles 24 including a vertically extending body portion 26, found in substantially a circular base portion 28, the lower end 29 of which is mounted upon the upper surface 20 of barrier 12. Typically, each of the paddles 24 would include a series of vertical slots 30, and base 28 would be mounted onto surface 20 via a pair of anchor bolts secured into the median barrier 12, the anchor bolts which are not illustrated. Further in the use of the plurality of paddles 24 in the preferred embodiment, each of the paddles would be approximately twenty inches apart, mounted along the length of the barrier system 12.

In order to effect a continuous anti-glare shield, the series of paddles 24 as illustrated must be mounted angularly in relation to the length of the barrier system 12. In effect, although there is a gap approximately twenty inches between each of the paddles 24 as illustrated in FIG. 1, because the paddles 24 are positioned in an angular relationship to base 12, the edges 32 of each of the paddles. 24 when viewed from merging traffic, form the continuous barrier 12 between the lights of the merging traffic and the lights of the ongoing traffic. This positioning of paddles 24 in relation to the median barrier 12 is known in the industry and is used quite extensively.

Turning now to an element of the present invention which is new to the combination is the use of a mounting device 34, which is utilizing for housing the length of lighting assembly 36 as illustrated in FIG. 1. In a discussion of this particular feature, reference is made also to FIGS. 2 and 3 which illustrate the mounting device in top view and overall view respectively. As illustrated in the FIGURES, mounting device 34 includes a base portion 38, which is of a certain length, identical to the width of each of the paddles 24 as seen in FIG. 1, and is of the same overall configuration of the upper end 27 of each of the paddles 24 so that the mounting device 34 may be secured thereupon as seen in FIG. 1. Further, each device 34 includes an upper tube holding portion 40, which includes a continuous ring 42 defining an orifice 44 therethrough through which the lighting tubing 36 would be threaded as seen in FIG. 1. An important feature of the mounting device 34 is seen in FIG. 2. As illustrated, the base 38 of device 34, as was discussed earlier, is of substantially the same configuration as top 27 of each of the paddles 24 which is mounted thereupon. However, because each of the paddles 24 is positioned at an angle relative to the overall length of the median barrier 12, for the reasons explained earlier, the orifice 44 through which the lighting tube is threaded, must be formed so that the access of the orifice 44 is directly in line with the linear direction of the barrier 12. For example, as seen in FIG. 2, there is illustrated a sectional view of the lighting tubing 36, which is threaded through the orifice 44 and is held in place therein. There is further illustrated the arrows 46, 48 which illustrate the direction of the lighting assembly 36 as it extends along the barrier 12, and also the direction of the median barrier 12. As seen, the lower base portion 38 is mounted upon each of the glare paddles 24 which are angularly positioned in relation to the lighted tube 36. In order to obtain this feature, there is provided a curved continuous upper side wall 50 of the mounting device 34 to form an arcuate angle between the base 38 and the upper portion 52 of the device 34 as seen in FIG. 2. The arcuate angle of side 50 is such that it enables the base 38 to be positioned in the direction of the width of each of the glare paddles 24, yet allows the orifice 44 to be positioned in alignment with the lighted tube 36 which is also in the same alignment of the median barrier 12.

In FIG. 1, it is illustrated that each of the mounting devices 34 is mounted upon each of the glare paddles 24. However, it may be that it is not necessary to place a mounting device on each of the glare paddles 24, but may be mounted on either the third or fourth glare paddle 24, depending on the structural integrity required for the particular system under construction.

Furthermore, as seen in FIG. 1, the lighting tubing 36 would further include a main power supply 40, which would in the preferred embodiment have approximately a 1,000 watt capacity, and would provide electrical power to the lighting tubing 36, which in the preferred embodiment would consist of 50 watt lamps to form the entire lighting assembly.

The following table lists the part numbers and part descriptions as used herein and in the drawings attached hereto.

PARTS LIST

| Description | Part No. |
|---|---|
| system | 10 |
| median barrier | 12 |
| base portion | 14 |
| side walls | 16, 18 |
| flat top portion | 20 |
| highway surface | 22 |
| paddles | 24 |
| body portion | 26 |
| upper end | 27 |
| base portion | 28 |
| lower end | 29 |
| vertical slots | 30 |
| edges | 32 |
| mounting device | 34 |
| lighting assembly | 36 |
| base portion | 38 |
| main power supply | 40 |
| lamps | 42 |
| orifice | 44 |
| arrows | 46, 48 |
| side wall | 50 |
| upper portion | 52 |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A lighted anti-glare system for highway medians, comprising:

a) a highway having a length, a center line, and an edge, and a median barrier along the center line of the highway or along the edge of the highway;

b) a plurality of anti-glare paddles mounted on said median barrier and spaced apart from one another angularly for forming a continuous anti-glare barrier, said anti-glare paddles each having an upper portion;

c) a lighting assembly, positioned atop the plurality of anti-glare paddles, the lighting assembly secured to at least two of the anti-glare paddles, so that the lighting assembly is aligned with the length of the highway, for providing a continuous source of light atop the plurality of anti-glare paddles; and d) a mounting device further comprising a base portion which is configured in line with and secured to the upper portion of at least some of the anti-glare paddles, including an orifice which is formed in an angular relation from the base portion for housing the lighting assembly therethrough in alignment with the median barrier.

2. The system in claim 1, wherein the plurality of anti-glare paddles is mounted upon a median barrier positioned along the center line or edge of the highway, the median barrier having a substantially flat upper portion upon which the anti-glare paddles are mounted.

3. The system in claim 1, wherein the lighting assembly further comprises a continuous lighting tube adapted to be approximately eye level with a driver of a vehicle on the highway.

4. A lighted anti-glare system for highway medians, comprising:

a) a median barrier positioned along the edge or center line of a highway, and having a substantially flat upper portion;

b) a plurality of anti-glare paddles mounted on a top portion of the median, the glare paddles spaced apart from one another, and positioned at an angle relative to a length of the median, for forming a continuous anti-glare barrier;

c) a lighting assembly, positioned along the length of the median barrier atop the plurality of glare paddles, the lighting assembly secured with a mounting device having a base portion configured in line with and secured to an upper end of at least some of the anti-glare paddles, and an orifice which is formed in an angular relation from the base portion, to house the lighting assembly therethrough in alignment with the median barrier.

5. The system in claim 4, wherein there is further included a source of electrical power for providing power to the lighting assembly mounted on the anti-glare paddles.

6. The system in claim 4, wherein the lighting assembly further comprises a continuous lighting tube adapted to be approximately eye level with a driver of a vehicle on the highway.

7. The system in claim 4, wherein the lighting assembly is comprised of a plurality of 50 watt lights forming a continuous lighted assembly along the entire length of the median barrier.

8. The system in claim 4, wherein the mounting device is secured along at least every four anti-glare paddles positioned on the median barrier.

9. A lighted anti-glare system for highway medians, comprising:

a) a highway having a center line;

b) a median barrier positioned along the center line of the highway, said median barrier having a substantially flat upper portion and a length;

c) a plurality of anti-glare paddles mounted on the upper portion of the median barrier, the glare paddles spaced apart from one another, and positioned at an angle relative to the length of the median barrier, for forming a continuous anti-glare barrier;

d) a lighting assembly, positioned along a length of the median barrier atop the plurality of anti-glare paddles, the lighting assembly secured with a mounting device having a base portion configured in line with and secured to an upper end of at least some of the anti-glare paddles, and an orifice which is formed in an angular relation from the base portion, to house the lighting assembly therethrough in alignment with the median barrier at a height of approximately eye level with a driver of an automobile on the highway.

* * * * *